US005463814A

United States Patent [19]

Stowell et al.

[11] Patent Number: 5,463,814

[45] Date of Patent: Nov. 7, 1995

[54] SHEARS

[75] Inventors: Davin Stowell, New York, N.Y.; Daniel J. Formosa, Montvale, N.J.

[73] Assignee: General Housewares Corp., Terre Haute, Ind.

[21] Appl. No.: 308,578

[22] Filed: Sep. 19, 1994

[51] Int. Cl.[6] ..... B26B 13/12

[52] U.S. Cl. ..... 30/232; 30/298

[58] Field of Search ..... 30/231, 232, 340, 30/298

[56] References Cited

U.S. PATENT DOCUMENTS

| | | |
|---|---|---|
| 98,826 | 1/1870 | Wendt . |
| 1,055,910 | 3/1913 | Hoover . |
| 2,072,140 | 12/1934 | Smith . |
| 2,370,026 | 4/1943 | Elia . |
| 2,421,339 | 2/1943 | Leger . |
| 2,875,520 | 9/1958 | Webster . |
| 3,861,038 | 1/1975 | Charles et al. . |
| 3,869,793 | 3/1975 | Ferguson . |
| 4,980,975 | 1/1991 | Hodson . |
| 5,063,671 | 11/1991 | Huang . |
| 5,179,783 | 1/1993 | Melter . |
| 5,279,034 | 1/1994 | Smith et al. . |

FOREIGN PATENT DOCUMENTS 81 of 1866 United Kingdom ..... 30/254

*Primary Examiner*—Douglas D. Watts
*Attorney, Agent, or Firm*—Emrich & Dithmar

[57] ABSTRACT

Shears have two crossed pivotally interconnected levers, each having a blade end and a handle end, and normally biased open. Upper and lower handles are, respectively, connected to the handle ends of the levers, the upper handle having a low-friction outer surface and including front, rear and medial portions, while the lower handle has a high-friction outer surface with a downwardly convex lower portion. The front portion of the upper handle projects upwardly to stop forward movement of the hand. The medial portion is of reduced cross section to facilitate hooking of the user's thumb thereover. The rear portion has a laterally upwardly and inwardly sloping upper surface. An elastomeric loop depends from the lower handle rearwardly of the front portion of the upper handle and receives therethrough only the middle finger of the user's hand.

17 Claims, 3 Drawing Sheets

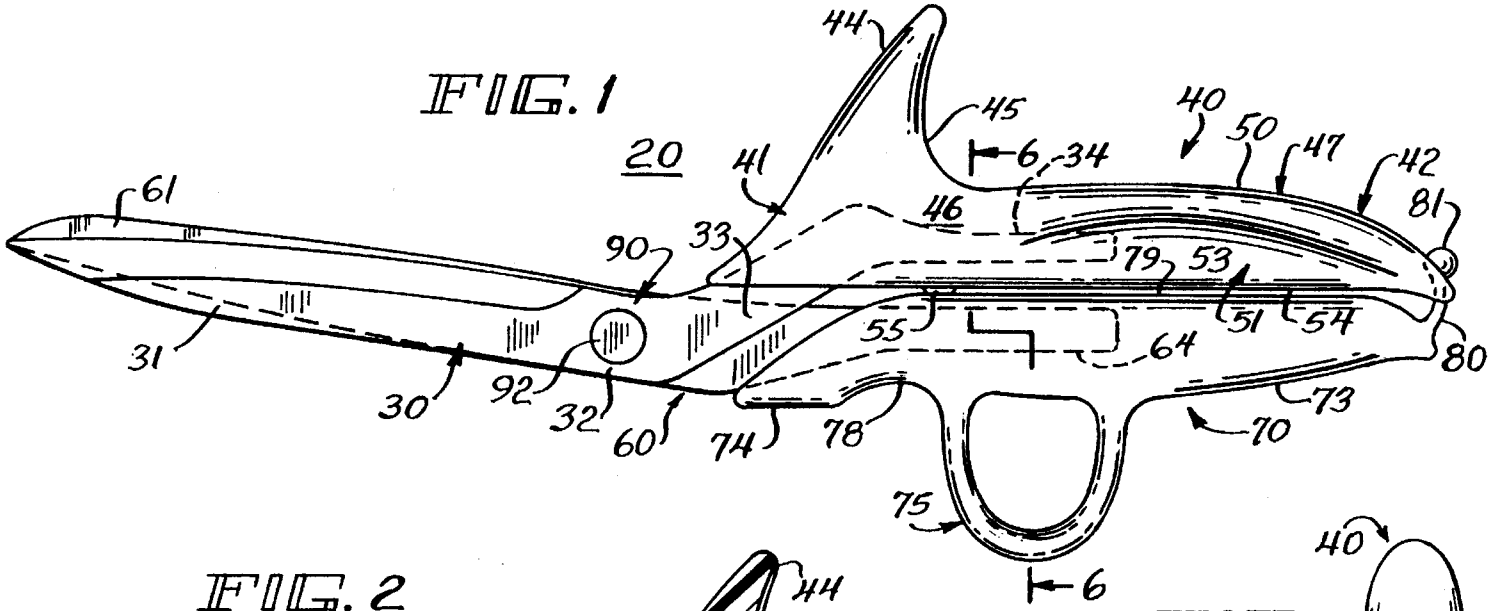
FIG. 1
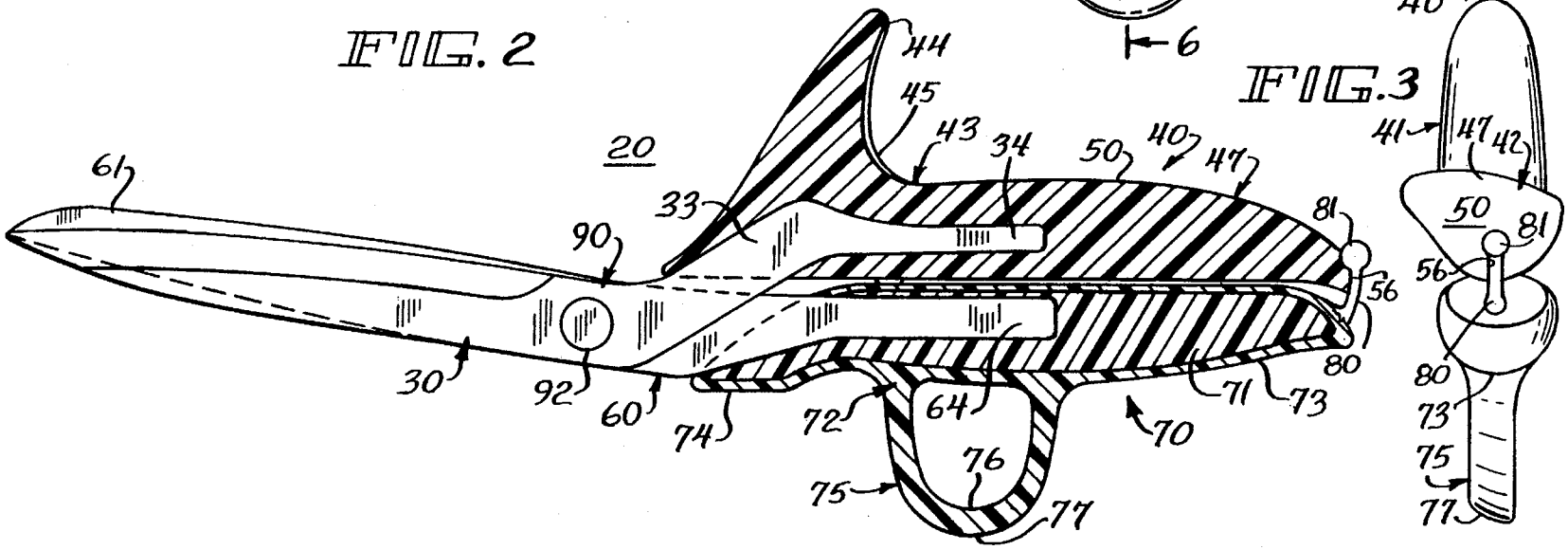
FIG. 2
FIG. 3

FIG. 6
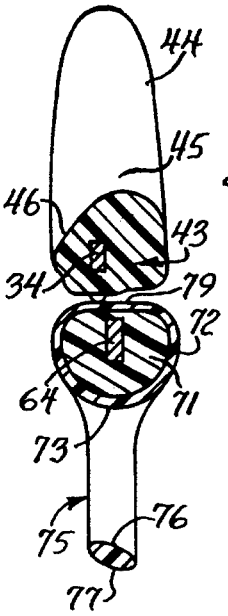
FIG. 8
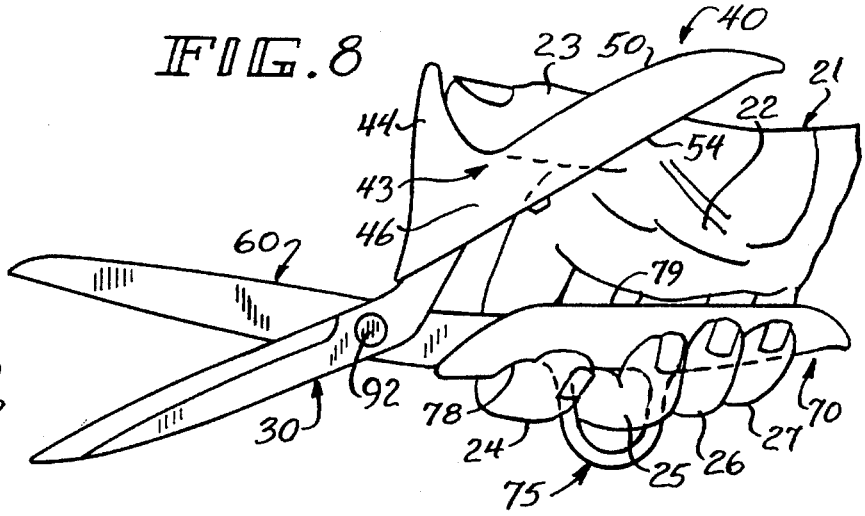
FIG. 9
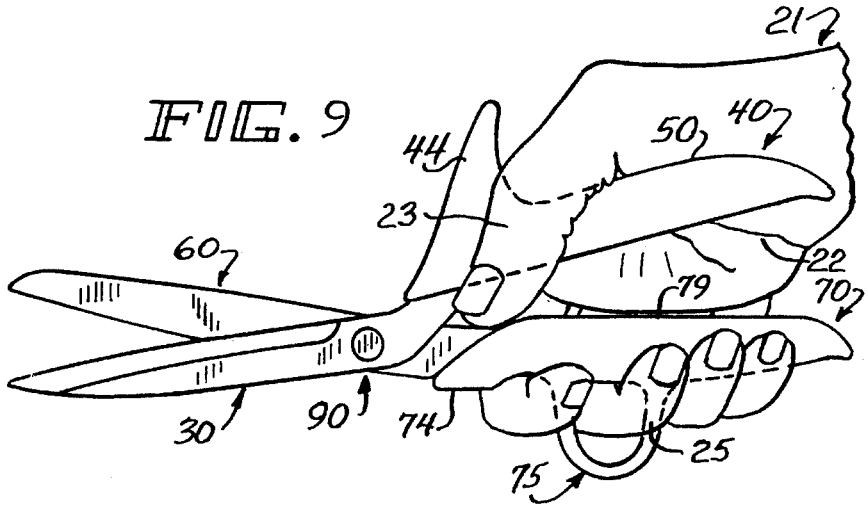
FIG. 7
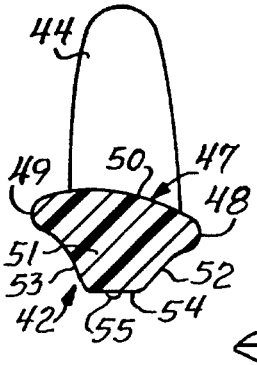
FIG. 10
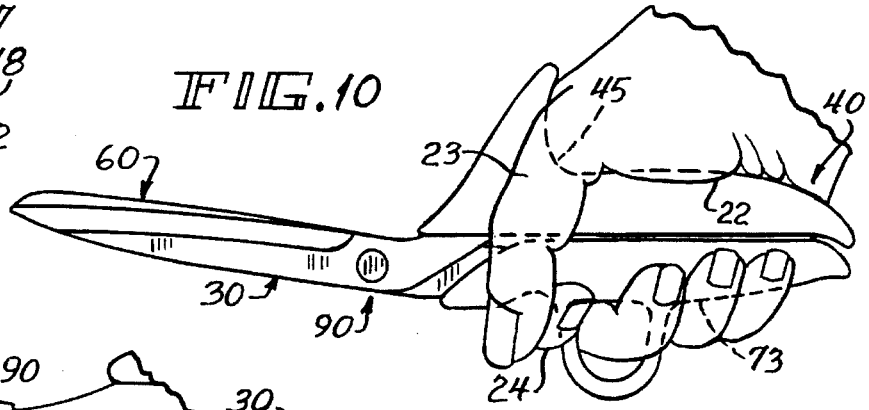
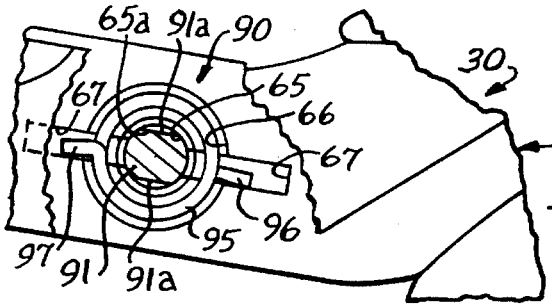
FIG. 11

SHEARS

BACKGROUND OF THE INVENTION

1. Field of the Invention

The present invention relates to scissors or shears of the pivoted, crossed-blade type, wherein the handles are normally biased open, and in particular relates to an ergonomic handle configuration for such shears.

2. Description of the Prior Art

Scissors or shears are used in many types of applications and in various industries, such as in the poultry industry. The users of such shears must manipulate them for long hours and must frequently exert considerable force to close the handles to cut the material to be sheared. Thus, user fatigue and development of carpel tunnel syndrome are a common conditions.

Efforts have been made to improve the design of such shears, and, particularly, the handles thereof, to alleviate user stress and fatigue. One such effort is disclosed in U.S. Pat. No. 5,279,034, which utilizes a lower handle with a loop for accommodating all but the index finger, and an upper handle with a contoured surface with a front upstanding projection or bollard to limit forward movement of the hand, and a laterally extending support for the thumb. But such shears have been found to have drawbacks in use. The lower loop tends to needlessly inhibit the flexing and uncurling of the fingers which are disposed therein. Also, such shears are especially designed for use in the poultry industry, many of the workers of which are women who have relatively small hands. It has been found that it is difficult for a user with small hands to adequately grip the shear handles in their normally-open condition and to exert enough force on them to close them, to cut the material to be sheared.

SUMMARY OF THE INVENTION

It is a general object of the invention to provide an improved shears which avoids the disadvantages of prior shears while affording additional structural and operating advantages.

An important feature of the invention is the provision of shears of the crossed pivoting lever type, which have ergonomically designed handles configured to minimize fatigue in use.

In connection with the foregoing feature, a further feature of the invention is the provision of shears of the type set forth, which are normally biased open and which facilitate grasping and closure by users with small hands.

A further feature of the invention is the provision of shears of the type set forth which facilitate sliding movement of the user's thumb from an initial grasping position to a final grasping and maximum force-exertion position.

Yet another feature of the invention is the provision of shears of the type set forth, which provide for retention of the shears on the user's hand, while minimizing inhibition of curling and uncurling movement of the user's fingers.

Another feature of the invention is the provision of shears of the type set forth, which provide for high frictional gripping by the user's fingers while affording free sliding movement of the user's thumb and palm on the shears handles.

Certain ones of these and other features of the invention are attained by providing shears having two crossed pivotally interconnected levers, each having a blade end and a handle end, and being pivotally movable between open an closed conditions and normally biased to the open condition, the improvement comprising: an upper handle connected to one of the lever handle ends and disposed for engagement in use with the thumb and palm of a user's hand, and a lower handle connected to the other of the lever handle ends and disposed for engagement in use with the fingers of a user's hand, the upper handle having an outer surface formed of a low-friction material and including a rear portion and a front portion and a medial portion between the front and rear portions, the front portion projecting upwardly above the rear and medial portions for engagement with the thumb and the web between the thumb and forefinger of a user's hand to limit forward movement of the hand along the upper handle, the medial portion having a cross-sectional area substantially less than those of the front and rear portions and adapted to facilitate hooking thereover of the distal thumb joint of a user's hand, the low-friction material cooperating with the medial portion to facilitate sliding movement of a user's hand between an initial gripping position when the handles are in the open condition to a final gripping position when the handles are in the closed condition, wherein in the initial gripping position only the distal thumb joint of the user's hand is hooked over the medial portion and in the final gripping position the user's thumb extends downwardly alongside the upper handle to the lower handle with the palm of the hand overlying the rear portion of the upper handle.

Other features of the inventions are attained by providing shears having two crossed pivotally interconnected levers, each having a blade end and a handle end, and being pivotally movable between open and closed conditions and normally biased to the open condition, the improvement comprising: an upper handle connected to one of the lever handle ends and disposed for engagement in use with the thumb and palm of a user's hand, and a lower handle connected to the other of the lever handle ends and disposed for engagement in use with the fingers of a user's hand, the upper handle having a front portion projecting upwardly above the remainder of the upper handle for engagement with the thumb and the web between the thumb and forefinger of a user's hand to limit forward movement of the hand along the upper handle, the lower handle having a loop depending therefrom rearwardly of the front portion of the upper handle and positioned and dimensioned to receive therethrough in use only the middle finger of a user's hand.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 1 is a side elevational view of the shears of the present invention, latched in their closed condition;

FIG. 2 is a view similar to FIG. 1, with the handles shown in vertical section;

FIG. 3 is an end elevational view of the shears of FIG. 1, as viewed from the right-hand end thereof;

FIG. 6 is a view in vertical section taken along the line 6—6 in FIG. 1;

FIG. 7 is a view in vertical section taken along the line 7—7 in FIG. 5;

FIG. 8 is a reduced view of the shears in their open condition as initially grasped by a user's hand;

FIG. 9 is a view similar to FIG. 8, showing the shears and the user's hand in a partially closed condition;

FIG. 10 is a view similar to FIG. 9, showing the shears and the user's hand in the fully closed condition; and FIG. 11 is an enlarged fragmentary view of the joint portion of FIG. 1, with a portion broken away to show the internal construction.

DESCRIPTION OF THE PREFERRED EMBODIMENT

Figure 4:
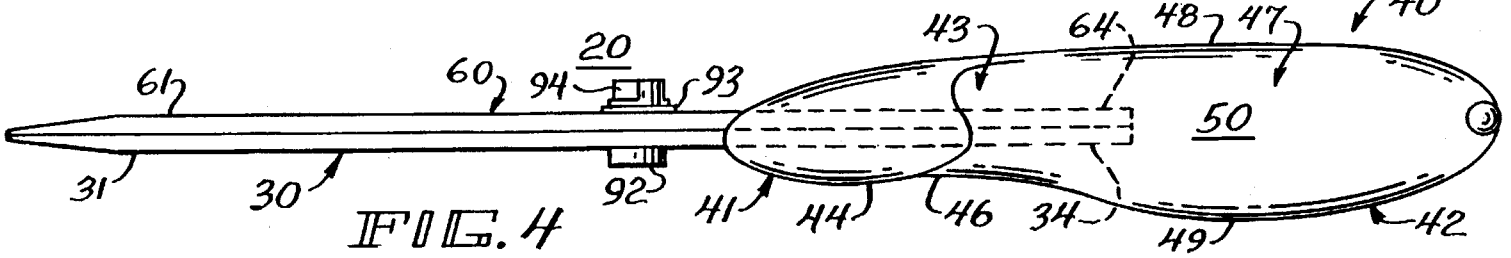
FIG. 4 is a top plan view of the shears of FIG. 1.

Referring to the drawings, there is illustrated a shears 20, constructed in accordance with an embodying the features of the present invention. The shears 20 is of the crossed, pivoting lever type, including an upper lever 30 having an upper handle 40 and a lower lever 60 having a lower handle 70, the levers 30 and 60 being pivotally interconnected at a pivot joint 90. The shears are arranged to be manipulated, in use, by a single hand 21 of a user (see FIGS. 8–10). More specifically, the user's palm 22 and thumb 23 are engageable with the upper handle of 40, while the user's fingers 24–27 are engageable with the lower handle 70, in a manner which will be more fully described hereinafter.

Referring in particular to FIGS. 1–7, the upper lever 30 includes an elongated blade end 31, an intermediate joint region 32, an inclined portion 33, inclined at a predetermined angle with respect to the blade end 31, and a handle end 34 integral with the inclined portion 33 and extending rearwardly therefrom. A circular bore (not shown) is formed through the joint region 32. Formed on the inner surface of the joint region 32 is an annular recess (not shown) surrounding the bore and communicating with diametrically opposed and radially outwardly extending recess spurs (not shown), which also communicate with the bore, as will be explained more fully below. Preferably, the upper lever 30 is of unitary, one-piece construction, being formed of a suitable metal, such as stainless steel.

The upper handle 40 is preferably molded around the handle end 34, being formed of a suitable hard plastic material having a low-friction outer surface. The upper handle 40 has a front portion 41 which is formed around the inclined portion 33 of the upper lever 30, a rear portion 42 which projects rearwardly from the handle end 34, and a medial portion 43 joining the front and rear portions 41 and 42. The front portion 41 includes an upstanding projection 44, the rear face of which joins with the medial portion 43 to define a curved saddle 45. The medial portion 43 has a downwardly and laterally inwardly sloping inner surface 46, which slopes downwardly and forwardly from the saddle 45. The rear portion 42 has a wide, generally flattened upper part 47, which has laterally outer and inner curved sides 48 and 49 (see FIGS. 4 and 7) and a broad upwardly convex upper surface 50, which slopes upwardly from the outer side 48 to the inner side 49. As is best seen in FIG. 7, the rear portion also has a base 51 which is narrower than the upper part 47 and depends therefrom, the base 51 having laterally outer and inner side surfaces 52 and 53 and an elongated, flat, bottom surface 54 which is generally parallel to the handle end 34 of the upper lever 30. A stop button 55 depends from the flat bottom surface 54 adjacent to the forward end thereof. Formed axially into the rear portion 42 of the upper handle 40 at the rear end thereof is a slot or notch 56.

As can best be seen in FIGS. 4–7, the medial portion 43 has a transverse cross-sectional area which is substantially less than those of the front and rear portions 41 and 42, and the upper part 47 of the rear portion 42 is substantially wider, laterally of the handle, than are the front and medial portions 41 and 43.

The lower lever 60 is also of unitary, one-piece construction of the same material as the upper lever 30, and includes an elongated blade end 61, a joint region 62 and a handle end 64. Formed laterally through the joint region 62 is a bore 65 which is generally circular with flattened, diametrically opposed sides **65*a* (FIG. 11). Formed on the inner surface of the joint region 62 in surrounding relationship with the bore 65 is an annular recess 66 which communicates with diametrically opposed and radially outwardly extending recess spurs 67, which communicate with the bore 65**.

The lower handle 70 is preferably of molded plastic construction and includes a core 71 which is molded around the handle end 64 of the lower lever 60, and a surrounding outer sheath 72 which is formed of a suitable elastomeric material having a relatively high coefficient of friction. The lower handle 70 has a downwardly convex lower surface 73 which is curved generally to accommodate the curled fingers of the user's hand 21, the lower surface 73 having a generally flat front portion 74 at the front end thereof.

Depending from the lower surface 73 just rearwardly of the front portion 41 of the upper handle 40 is a loop 75 which is generally oval in transverse cross section (see FIG. 6), and the lower end of which has inner and outer surfaces 76 and 77, which slope laterally upwardly and inwardly. Formed in the lower surface 73 just forwardly of the loop 75 is a recess 78. The lower handle 70 has a generally flat, elongated upper surface 79 disposed for facing parallel relationship with the flat bottom surface 54 of the upper handle 40, when the handles 40 and 70 are in their closed condition, as can best be seen in FIGS. 1 and 2.

Fixed to the rear end of the lower handle 70 and projecting rearwardly therefrom is an elongated, flexible latch finger 80 having an enlarged bead 81 at its distal end. The latch finger 80 is dimensioned so as to be receivable in the notch 56 in the upper handle 40 when the handles are in their closed condition, the bead 81 having a diameter greater than the width of the notch 56, so that the latch finger 80 can latch the handles 40 and 70 together in their closed condition, as is illustrated in FIGS. 1–3.

Figure 5:
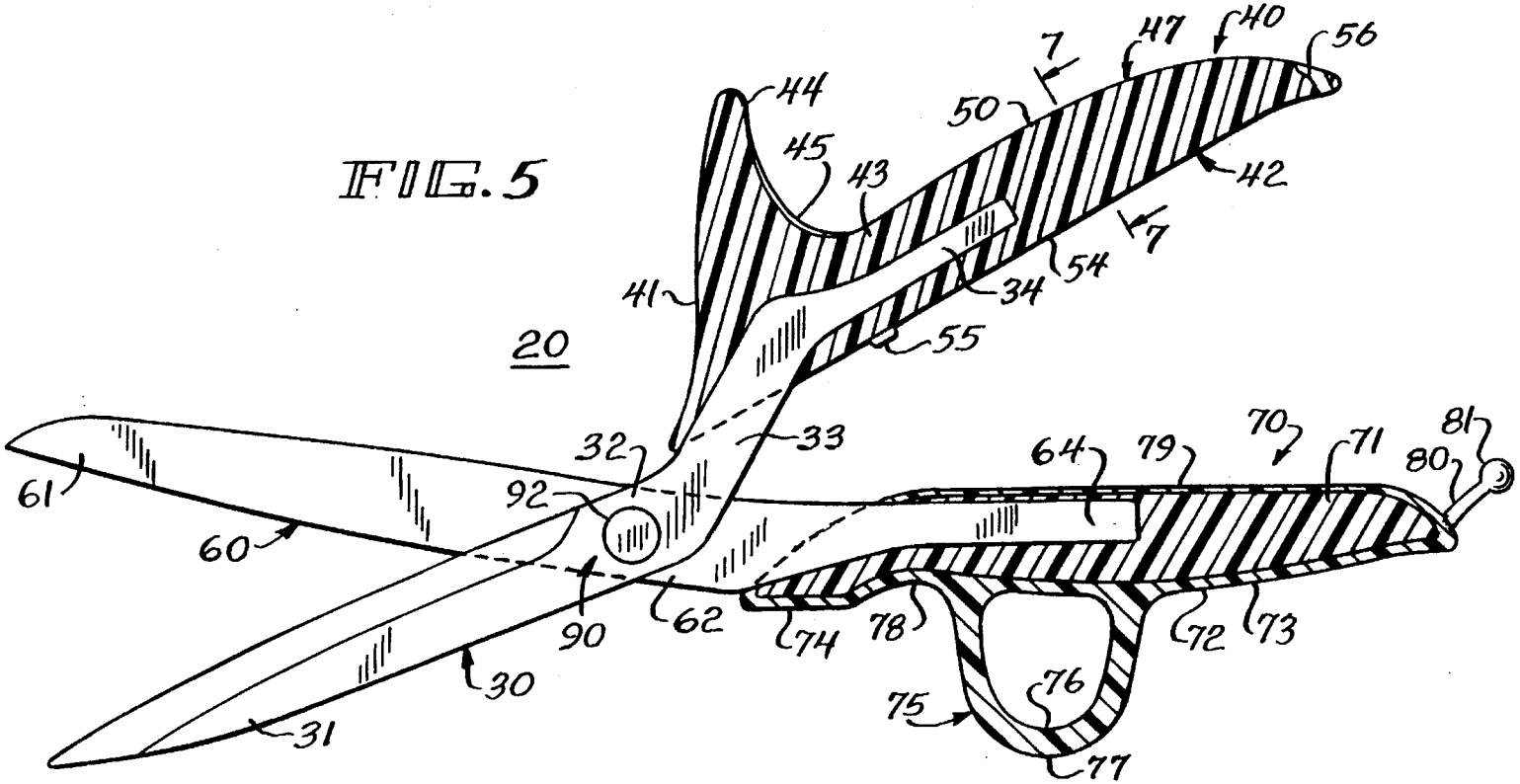
FIG. 5 is a view similar to FIG. 2, but with the shears in their normal open condition.

Referring in particular to FIGS. 4, 5 and 11, the joint 90 between the levers 30 and 60 includes a bolt 91 dimensioned to fit through the bore in the upper lever 30 and having diametrically opposed flats **91*a* dimensioned to be matably received through the bore 65 in the lower lever 60. The bolt 91 has an enlarged-diameter head 92 at one end thereof. The joint also includes a washer 93 and a nut 94 adapted for threaded engagement with the distal end of the bolt 91. A torsion spring 95 is provided, having radially outwardly extending leaves 96 and 97**.

In assembly of the shears 20, the torsion spring 95 is seated in the annular recess of the upper lever 30 with one of the leaves 97 disposed in one of the recess spurs. The bolt 91 is then placed through the bore in the upper lever 30 with the bolt head 92 seated against the outer surface of the joint region 32 of the upper lever 30, and with the flats 91*a* extending generally perpendicular to the recess spurs 37. The lower lever 60 is then overlapped with the upper lever 30 so that the inner surfaces thereof are in facing, back-to-back relationship, the lower lever 60 being oriented to receive the bolt 91 through the bore 65, with the flattened sides 65*a* disposed for mating engagement with the bolt flats 91*a*. In this configuration, the torsion spring 95 will be received in the annular recess 66, with the free leaf 96 being received in one recess spur 67. The washer 93 is then placed over the threaded end of the bolt 91 and the nut 94 is threadedly engaged therewith to complete the joint 90. It can be seen that, when thus assembled, the levers 30 and 60 are biased to an open condition, illustrated in FIG. 5, and are moved to a closed condition, shown in FIG. 1, against the urging of the torsion spring 95.

Referring in particular to FIGS. 8–10, the operation of the shears 20 will be described in detail. The user grasps the lower handle 70 with the curled fingers 24–27 of the hand 21, with the middle finger 25 being received through the loop 75, and with the index finger 24 being received in the recess 78. As can be seen, the contour of the lower surface 73 of the lower handle 70 is curved to comfortable fit the curved fingers of the hand 21. When the shears 20 are in their open condition, a user with a relatively small hand will not be able to place his or her palm 22 over the upper handle 40 while the fingers 24–27 are grasping the lower handle 70. Thus, the user will have to initially grasp the upper handle 30 by hooking the first joint of the thumb 23 over the medial portion 43 of the upper handle 40 in the saddle 45, as is illustrated in FIG. 8. It will be appreciated that the reduced-cross section, necked-down configuration of the medial portion 43 facilitates this hooking of the thumb 23 over the upper handle 30, while the projection 44 of the front portion 41 prevents the thumb 23 from sliding forwardly off the upper handle 30. It will further be appreciated that, during this initial grasping operation, the fingers 24, 26 and 27 are unencumbered and can be freely uncurled and curled to obtain a good grip, only the middle finger 25 being restrained by the loop 75 to capture the shears and prevent accidental dropping thereof during manipulation.

Since initially only the tip of the thumb 23 is hooked over the upper lever 30, the user cannot exert full force on the shears 20 but can exert sufficient force to begin to pivot the levers 30 and 60 toward their closed condition. As the handles 30 and 70 begin to move closer together, the user's thumb can be slid further up over the upper handle 40, the sloping inner surface 46 of the medial portion 43 facilitating sliding of the user's thumb 23 downwardly alongside the upper handle 40, as can be seen in FIG. 9. When the first joint of the thumb is thus moved to the inner surface 46 of the medial portion 43, considerably more force can be exerted by the user. During the continued closing of the handles, the hand 21 continues to slide up over the upper handle 40, until the user's palm 22 is disposed on top of the rear portion 42 of the upper handle 40, with the thumb 23 extending completely down along the inner sides of the upper and lower handles 40 and 70, as can be seen in FIG. 10, for exerting maximum closing force.

It is a significant aspect of the invention that the reduced-cross section shape of the medial portion 43, with its sloping inner surface 46, cooperates with the low-friction outer surface of the upper handle 40 to facilitate this sliding and hooking movement of the thumb 23 over the upper handle 40. The low-friction material of the upper handle 40 also facilitates sliding of the user's palm onto the rear portion 42 thereof. During this movement, it can be seen that the web between the user's thumb 23 and index finger 24 is brought into a position in the saddle 45 and during this entire movement the projection 44 of the front portion 41 limits forward movement of the user's hand 21.

It is another significant aspect of the invention that, because of the laterally inwardly and upwardly sloping configuration of the upper surface 50, as the user's hand 21 slides from the initial gripping position of FIG. 8 to the final gripping position of FIG. 10, the hand exerts a laterally inward force on the upper handle 40 as well as a closing force, thereby serving to tightly urge the blade ends 31 and 61 of the upper and lower lever 30 and 60 in to shearing engagement with each other. Also, the laterally inwardly and upwardly sloping surfaces of the loop 75 on the lower handle 70 facilitate insertion of the user's middle finger 25 and comfortably conform to the inclination of the curled finger. While the low-friction upper handle 40 facilitates easy sliding movement of the user's hand 21 among the gripping positions of FIGS. 8–10, the high-friction material of the lower handle 70 facilitates a firm gripping thereof by the user's fingers. It will be appreciated that the broad upper surface 50 of the upper handle 40 is adapted to comfortably fit into the user's palm 22.

It is another significant aspect of the invention that the loop 75 of the lower handle 70 is formed of an elastomeric material and is preferably dimensioned so that its depth (from the surface 64 to the surface 76 in FIG. 2) is sufficient to accommodate the largest finger, but its width, from the forward end of the loop to the rearward end of the loop, is sized slightly narrower than the average-sized finger width. This is because if the loop 75 were made of a rigid material and wide enough to accommodate the largest finger, it would tend to require spreading of the fingers of a user with a small hand. Because of the elastomeric nature of the loop 75, it is flexible and will spread to accommodate a large middle finger.

The stop button 55 is disposed for engagement with the flat upper surface 79 of the lower handle 70 to limit pivotal movement of the handles 40 and 70 toward each other to define the closed condition of the shears 20. The stop button 55 may be filed or ground down, as desired, to fine-tune the position of the blade ends of the shears 20 in their closed condition.

From the foregoing, it can be seen that there has been provided an improved shears which is of simple and economical construction, and which has ergonomically designed handles to minimize user fatigue by facilitating grasping and operation by users with relatively small hands.

We claim:

1. In shears having two crossed pivotally interconnected levers, each having a blade end and a handle end, and being pivotally movable between open and closed conditions and normally biased to the open condition, the improvement comprising:

an upper handle connected to one of the lever handle ends and disposed for engagement in use with the thumb and palm of a user's hand, and a lower handle connected to the other of the lever handle ends and disposed for engagement in use with the fingers of a user's hand, said upper handle having an outer surface formed of a low-friction material and including a rear portion and a front portion and a medial portion between said front and rear portions, said front portion projecting upwardly above said rear and medial portions for engagement with the thumb and the web between the thumb and forefinger of a user's hand to limit forward movement of the hand along said upper handle, said medial portion having a cross-sectional area substantially less than those of said front and rear portions and adapted to facilitate hooking thereover of the distal thumb joint of a user's hand, said low-friction material cooperating with said medial portion to facilitate sliding movement of a user's hand between an initial gripping position, wherein only the distal thumb joint of a user's hand is hooked over said medial portion when the handles are in the open condition, to a final gripping position, wherein the user's thumb extends downwardly alongside said upper handle to said lower handle with the palm of the hand overlying said rear portion of the Upper handle when the handles are in the closed condition, said lower handle having an outer surface formed of a high-friction material for cooperation with he low friction material of said upper handle to cause the user's hand to slip only along said upper handle, thereby to facilitate movement from the initial gripping position to the final gripping position as the handles are closed.

2. The shears of claim 1, wherein said lower handle has a lower surface which is downwardly convex and shaped and dimensioned to conform to the curled fingers of a user's hand.

3. The shears of claim 1, wherein said upper and lower handles are formed of plastic.

4. The shears in claim 1, wherein said rear portion has a laterally outer side and a laterally inner side and an upper surface which slopes upwardly from said outer side to said inner side.

5. The shears of claim 4, wherein said rear portion of said upper handle has a lateral width substantially greater than the lateral width of said lower handle.

6. The shears of claim 1, and further comprising latch structure for holding said handles together in the closed condition.

7. The shears of claim 6, wherein said latch structure includes a notch formed axially in said rear portion of said upper handle, and a flexible latch member projecting from said lower handle and receivable in said notch and having an enlarged distal end to retain said latch member in said notch.

8. In shears having two crossed pivotally interconnected levers, each having a blade end and a handle end, and being pivotally movable between open and closed conditions and normally biased to the open condition, the improvement comprising:

an upper handle connected to one of the lever handle ends and disposed for engagement in use with the thumb and palm of a user's hand, and a lower handle connected to the other of the lever handle ends and disposed for engagement in use with the fingers of a user's hand, said upper handle having a front portion projecting upwardly above the remainder of said upper handle for engagement with the thumb and the web between the thumb and forefinger of a user's hand to limit forward movement of the hand along said upper handle, said lower handle having a loop depending therefrom rearwardly of said front portion of said upper handle and positioned and dimensioned to receive therethrough in use only the middle finger of a user's hand, said loop being formed of a flexible and resilient material so as to be deformable to accommodate different size middle fingers and to cushion adjacent fingers of a user's hand.

9. The shears of claim 8, wherein said loop has a lower end with a laterally outer side and a laterally inner side and an inner surface which slopes upwardly from said outer side to said inner side.

10. The shears of claim 8, wherein said lower handle has a lower surface which is downwardly convex and shaped and dimensioned to conform to the curled fingers of a user's hand.

11. The shears of claim 8, further comprising latch structure for holding said handles together in the closed condition.

12. The shears of claim 8, wherein said upper and lower handles are respectively have flattened portions disposed in facing relationship with each other for abutment in the closed condition of said handles.

13. In shears having two crossed pivotally interconnected levers, each having a blade end and a handle end, and being pivotally movable between open and closed conditions and normally biased to the open condition, the improvement comprising:

an upper handle connected to one of the lever handle ends and disposed for engagement in use with the thumb and palm of a user's hand, and a lower handle connected to the other of the lever handle ends and disposed for engagement in use with the fingers of a user's hand, said upper handle having an outer surface formed of a low-friction material and including a rear portion and a front portion and a medial portion between said front and rear portions, said front portion projecting upwardly above said rear and medial portions for engagement with the thumb and the web between the thumb and forefinger of a user's hand to limit forward movement of the hand along said upper handle, said medial portion having a cross-sectional area substantially less than those of said front and rear portions and adapted to facilitate hooking thereover of the distal thumb joint of a user's hand, said lower handle having a loop depending therefrom rearwardly of said front portion of said upper handle and positioned and dimensioned to receive therethrough in use only the middle finger of a user's hand, said low-friction material cooperating with said medial portion to facilitate sliding movement of a user's hand between an initial gripping position, wherein only the distal thumb joint of a user's hand is hooked over said medial portion when the handles are in the open condition, to a final gripping position, wherein the user's thumb extends downwardly alongside said upper handle to said lower handle with the palm of the hand overlying said rear portion of the upper handle when the handles are in the closed condition, said lower handle having an outer surface formed of a high-friction material for cooperation with the low friction material of said upper handle to cause the user's hand to slip only along said upper handle, thereby to facilitate movement from the initial gripping position to the final gripping position as the handles are closed.

14. The shears of claim 13, wherein said lower handle has a lower surface which is downwardly convex and shaped and dimensioned to conform to the curled fingers of a user's hand.

15. The shears of claim 13, wherein said rear portion has a laterally outer side and a laterally inner side and an upper surface which slopes upwardly from said outer side to said inner side.

16. The shears of claim 15, wherein said rear portion of said upper handle has a lateral width substantially greater than the lateral width of said lower handle.

17. The shears of claim 13, and further comprising latch structure for holding said handles together in the closed condition.

* * * * *